United States Patent [19]

Sibidi

[11] 4,025,234

[45] May 24, 1977

[54] APPARATUS FOR OBTAINING ARTIFICIAL GRAVITY IN LIQUIDS

[75] Inventor: Juan Ramoneda Sibidi, C/. Quevedo No. 56, Sabadell (Barna), Spain

[73] Assignee: Mecano Quimica S.A., Barcelona, Spain

[22] Filed: Feb. 20, 1975

[21] Appl. No.: 551,385

[30] Foreign Application Priority Data

Feb. 21, 1974 Spain ..... 423474

[52] U.S. Cl. ..... 417/28; 137/209; 137/211

[51] Int. Cl.[2] ..... F04B 49/00; F04F 1/18

[58] Field of Search ..... 417/28, 40, 295, 26; 137/209, 211

[56] References Cited

UNITED STATES PATENTS

| | | | |
|---|---|---|---|
| 2,431,640 | 11/1947 | Gordon | 417/28 |
| 2,988,002 | 6/1961 | Dodd | 137/211 |
| 3,002,460 | 10/1961 | Ward | 137/211 |
| 3,007,414 | 11/1961 | Long et al. | 417/28 |
| 3,035,522 | 5/1962 | Lung | 137/211 |
| 3,225,696 | 12/1965 | Brigman | 137/211 |
| 3,342,136 | 9/1967 | Domecki | 417/40 |

*Primary Examiner*—Carlton R. Croyle
*Assistant Examiner*—G. P. La Pointe

[57] ABSTRACT

Apparatus for supplying liquid at a constant but regulable pressure comprising a storage vessel having an inlet and an outlet, the outlet being adapted for connection to a utilization device which is to be fed with liquid at constant pressure. An inlet conduit is connected to the inlet of the vessel and a pump is connected in the inlet conduit for pumping liquid from a liquid supply to the inlet of the vessel. A valve is inserted in the inlet conduit upstream of the pump for preventing reverse flow of liquid to the liquid supply when the pressure in the utilization device exceeds the static pressure due to the liquid height in the vessel. The valve is coupled to the pump to be opened and closed in accordance with starting and stopping thereof. The vessel includes an air inlet duct including a regulating device for adjusting the air pressure in the air chamber of the vessel from zero to a predetermined maximum. The air inlet duct maintains a constant air pressure in the vessel to maintain the liquid therein at a given constant pressure.

4 Claims, 2 Drawing Figures

APPARATUS FOR OBTAINING ARTIFICIAL GRAVITY IN LIQUIDS

FIELD OF THE INVENTION

The present invention relates to apparatus for obtaining artificial gravity in liquids, with which highly efficient results are obtained in the filling operation of any type of utilization device.

BACKGROUND

In diverse types of mechanisms for filling devices of various classes, it is necessary to have tanks of liquid at a determined height so that the liquid reaches the filling mechanisms at suitable manometric pressure. For the same reason and in accordance with the diverse physical characteristics of the liquids, this must vary. This causes the need for constructing support towers for the tanks at heights which are generally inconvenient, and with the requirements to vary such heights. according to need. This requires the installation of regulating devices which make the equipment both more complicated and expensive.

In another sphere, it is already known that in liquid-feeding devices for filling mechanisms for diverse types of utilization devices a pump is employed. However, deficiencies are observed with regard to the pressure conditions, i.e. to the establishment of differences of pressure of the liquid which is being fed. The pressure of the liquid must not vary but should be kept constant with absolute precision. Generally, conventional pumps do not guarantee the non-return of the liquid; they are not one-directional; they are not even leak-proof, so that, when the pump is stopped, the liquid can flow in one direction or the other according to the manometric pressure of the liquid.

DETAILED DESCRIPTION

Figure 1:
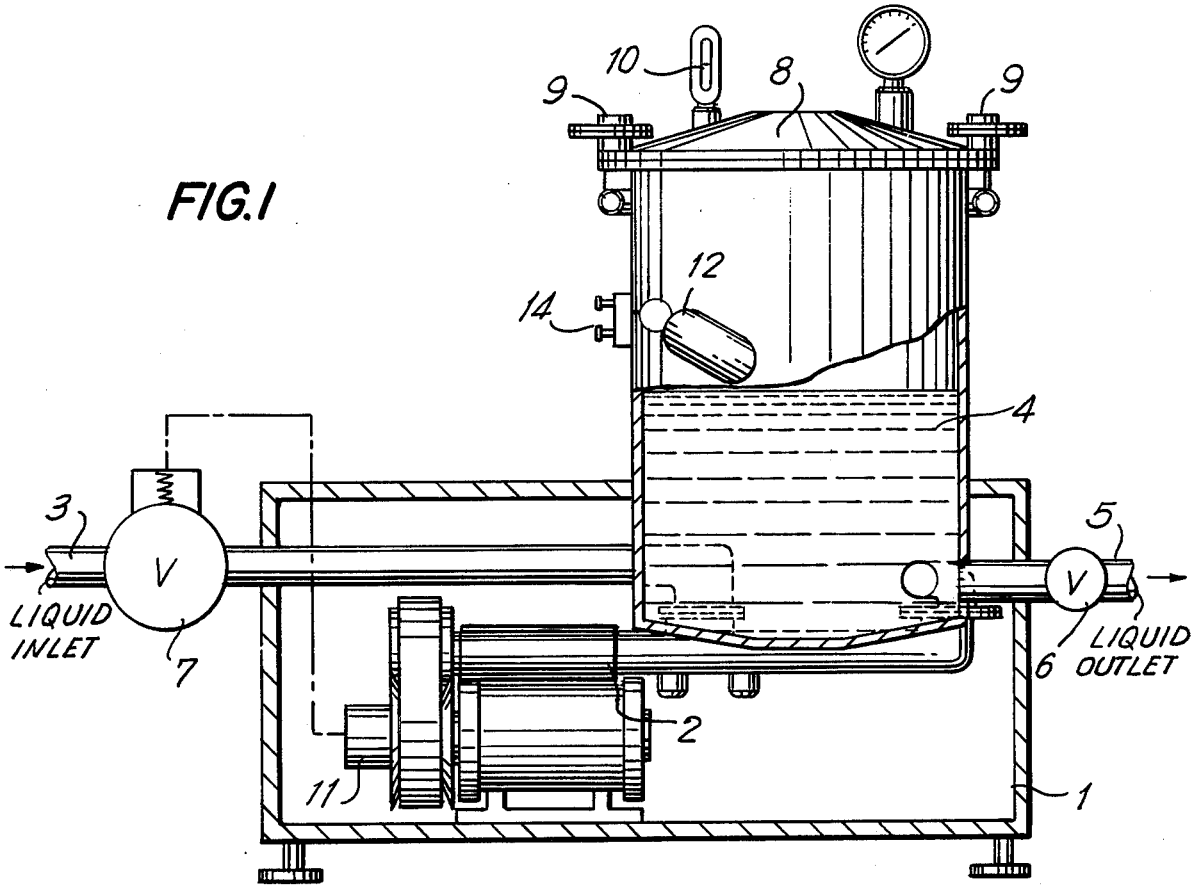
FIG. 1 is a diagrammatic, side elevational view of the apparatus according to the invention
Figure 2:
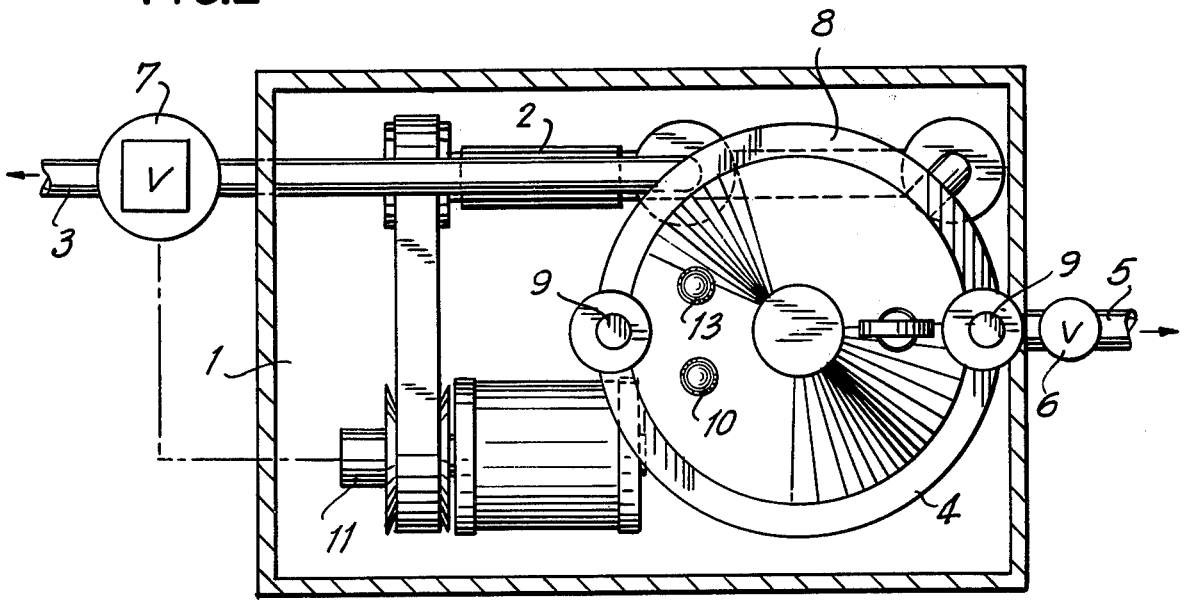
FIG. 2 illustrates the apparatus in FIG. 1 in top plan view.

Referring to the drawings, the apparatus comprises a suitable metallic supporting framework 1 on which a transfer pump 2 is mounted. The pump 2 serves to pump liquid from a supply tank (not shown) through a supply conduit 3 to a storage vessel 4. A discharge conduit 5 containing a valve 6 is connected at its inlet to the vessel 4 and its oulet can be connected to any type of filling machine (not shown) of any liquid utilization apparatus which operates at a specific liquid pressure.

In the inlet conduit 3 is a closure valve 7 which prevents liquid from returning to the supply tank if the working pressure in the filling machine exceeds the static pressure in vessel 4. The valve also prevents direct flow in the opposite direction as it opens and shuts automatically according to the stopping and starting of the pump 2.

The vessel 4 is advantageously provided with a water-tight seal in its casing which is secured by means of suitable anchoring devices 9 which are easily removed. The vessel has an air inlet duct 13, the pressure of which is adjustable, from zero to the maximum which is required which can reach 5 $Kg/cm^2$, so that the liquid which is pumped into the vessel by the pump 2 leaves at a pressure which has been established with precision in the free chamber of the vessel above the liquid level. By way of example, the air inlet duct can be connected to a conventional receiver coupled to an air compressor.

In order that there are no variations in the effect which the liquid undergoes on flowing to the filling machine from conduit 5 it is essential that the pressure be maintained with absolute precision. In view of the diverse variations which the pressure inside the vessel can undergo, coincident with the pumping in and discharge of liquid, the discharge of liquid without pumping liquid in the two taking-in positions with the pump stopped, an escape valve is provided with an adjustable gage 10 on the casing 8 of the vessel 4, so that when the liquid enters the vessel and there is no air introduction or it is less than the amount which should be introduced, the air escapes through the escape valve, thereby avoiding an accumulation and an increase in the pressure inside the vessel. On the contrary, when liquid has been introduced and the pump is stopped, air enters the vessel from the system, in regulated amount as indicated, thereby avoiding a decrease in pressure.

In order to establish, as precisely as possible, that there will be no pressure differences, the pump is driven by a motor equipped with a speed adjuster 11 which can be adjusted mechanically or electrically to regulate the liquid injection.

The apparatus contains two floats (only one of which is shown) 12, at the maximum and minimum levels which determine the stopping and starting of the pump.

It is notable that with the apparatus there is obtained an effect of artificial gravity which avoids the positioning of the storage vessel on relatively high supports, and the effect of which can be regulated as has been stated.

In operation, when the liquid in the vessel 4 drops below the level of the lower float 12, a switch 14 coupled to the float 12 is closed and this closes the supply circuit for the motor which drives pump 2. Valve 7 is concurrently opened and liquid is pumped by pump 2 into vessel 4. The escape valve allows discharge of air from the air chamber above the liquid level in vessel 4 so that the air pressure remains constant. Investigation of gage 10 insures that this condition is met. If necessary, air can be supplied to the vessel via air inlet 13 to make up any excess lost air. When the level of liquid reaches the upper float, the switch associated therewith is closed and the motor which drives pump 2 is stopped and valve 7 is closed. The air pressure is continuously maintained at the desired constant value by observing gage 10.

When the liquid is to be discharged from the vessel, the valve 6 is opened and liquid flows from the vessel through conduit 5 while concurrently the pressure in the air chamber in vessel 4 is maintained constant by inflow of air through air inlet 13. When the liquid falls below the level of the lower float 12, the motor of the pump is operated and valve 7 is opened, the operation then being at the initially described stage and being continuously repeated.

Of course, valves 6 and 7 can be open simultaneously during a utilization operation in which case liquid is pumped by pump 2 into vessel 4 while liquid flows from conduit 5 to the utilization device at a constant pressure, the air chamber in vessel 4 being maintained at a constant pressure.

Numerous variations and modifications of the disclosed embodiment can be made within the spirit and scope of the invention as defined in the appended claims.

What is claimed is:

1. Apparatus for supplying liquid at constant pressure comprising a storage vessel having an inlet and an outlet, said outlet being adapted for connection to a utilization device, an inlet conduit connected to the inlet of the vessel, a pump connected in said inlet conduit for pumping liquid from a supply thereof to said inlet of the vessel, a valve in said inlet conduit upstream of the pump for preventing reverse flow of liquid to the liquid supply when the pressure in the utilization device exceeds the pressure due to the liquid height in the vessel, said valve being coupled to said pump to be opened and closed in accordance with starting and stopping thereof, an air inlet duct coupled to said vessel and including regulating means for adjusting the air pressure from zero to a pre-determined maximum, said air inlet duct maintaining a constant air pressure in said vessel to maintain the liquid therein at a given constant pressure, an air outlet duct including an escape valve connected to the vessel, and a gage in said outlet duct whereby when liquid enters the vessel and there is no liquid discharge therefrom or the liquid discharge is less than the amount of entering liquid, the air escapes by said escape valve, thereby avoiding increase in air pressure inside the vessel whereas, when liquid is discharged and the pump is stopped, air enters the vessel via the inlet duct, thereby avoiding any decrease in air pressure.

2. Apparatus as claimed in claim 1 wherein said vessel includes a removable water-tight seal.

3. Apparatus as claimed in claim 1 wherein said pump includes speed adjustment means for regulating the injection of liquid into said vessel.

4. Apparatus as claimed in claim 1 comprising float means in said vessel for sensing liquid level therein and for operating said pump to maintain said liquid level.

* * * * *